United States Patent [19]

Till et al.

[11] 4,026,701

[45] May 31, 1977

[54] GAS IMPINGEMENT AND SUCTION CLEANING APPARATUS

[75] Inventors: Henry R. Till, Rochester; Nero R. Lindblad, Palmyra, both of N.Y.

[73] Assignee: Xerox Corporation, Stamford, Conn.

[22] Filed: Feb. 24, 1975

[21] Appl. No.: 552,392

[52] U.S. Cl. ..... 96/1 R; 15/306 A; 15/345; 134/21; 134/37; 355/15

[51] Int. Cl.[2] ..... A47L 5/38

[58] Field of Search ..... 15/306 A, 345, 346; 96/1 R; 134/21, 37; 355/15

[56] References Cited

UNITED STATES PATENTS

| | | | |
|---|---|---|---|
| 3,469,275 | 9/1969 | Deschuttere et al. | 15/345 X |
| 3,668,008 | 6/1972 | Severynse | 355/15 X |
| 3,737,940 | 6/1973 | Moestve et al. | 15/302 |
| 3,741,157 | 6/1973 | Krause | 15/345 X |
| 3,775,806 | 12/1973 | Olbrant et al. | 15/306 A |

*Primary Examiner*—Christopher K. Moore

*Attorney, Agent, or Firm*—James J. Ralabate; Michael H. Shanahan; Paul Weinstein

[57] ABSTRACT

An apparatus and process for cleaning the surface of an electrostatographic imaging member and an electrostatographic reproducing machine utilizing the cleaning apparatus. A device is provided for impinging a gas flow against the imaging surface for removing residual material therefrom and for applying suction to the surface to provide a suction flow for collecting the gas and the residual material and transporting them away from the imaging surface. Apparatus is provided for supporting the impingement device and the suction device close to the imaging surface including a device for forming a supporting gas cushion. In accordance with an alternative embodiment apparatus is provided for positioning the impingement and suction devices close to the imaging surface during operation of the cleaning system and away from the surface after the cleaning system has ceased to operate.

48 Claims, 14 Drawing Figures

GAS IMPINGEMENT AND SUCTION CLEANING APPARATUS

BACKGROUND OF THE INVENTION

This invention relates to a contactless cleaning apparatus and process for cleaning the imaging surface of an electrostatographic imaging member. An electrostatographic reproducing machine incorporating the aforementioned apparatus also forms part of this invention. In accordance with this invention a combination of high velocity gas impingement and suction are utilized to clean residual material from the surface of an electrostatographic imaging member.

The use of high pressure gas jets and suction for cleaning residual material from the surface of an electrostatographic imaging member is known in the art as set forth in U.S. Pat. No. 3,741,157, to Krause. This patent also shows the use of redundant cleaning systems in addition to the air jet and suction cleaning system and further indicates that the redundant cleaning systems may be selectively actuable.

In U.S. Pat. No. 3,615,813 to Clarke, an air blast and suction cleaning system is described wherein provision is made for simultaneously illuminating the surface of the electrostatic imaging member.

In U.S. Pat. Nos. 3,668,008 to Severynse, and 3,743,540 to Hudson, methods and apparatuses are described for cleaning residual toner from an electrostatographic imaging surface by providing a flow of ionized gas directed to the surface.

It is also known as suggested in U.S. Pat. No. 2,732,775 to Young et al., to employ an air jet and suction device for removing background toner from a developed image. In U.S. Pat. No. 3,645,618, the use of a vacuum nozzle to remove toner particles from a toner applicator is shown. In U.S. Pat. No. 3,336,904, the use of an air jet in a development apparatus is shown. U.S. Pat. Nos. 3,534,427; 3,615,398; 3,672,763; 3,794,839, and 3,821,027, also show the use of air streams as applied in electrostatographic apparatuses.

In addition to the foregoing patents the following patents, though not directly related to electrostatography, are of some interest with respect to air jet and suction cleaning. U.S. Pat. Nos. 3,239,863; 3,395,042; 3,531,201; 3,644,953; and 3,680,528.

The use of an air bearing or air cushion to space a stripper finger from the surface of an electrostatographic imaging member is known as set forth in U.S. Pat. No. 3,837,640, issued to Norton et al..

SUMMARY OF THE INVENTION

It has been found in accordance with the present invention that it is desirable to support a cleaning shoe containing gas pressure ports and suction ports as close as possible to the surface of the electrostatographic imaging member in order to increase the velocity of the gas which impinges on the surface. To support the shoe in such close proximity to the imaging surface, a gas bearing is utilized to provide a gas cushion so that the shoe may float against the imaging surface while being spaced therefrom by a very small gap.

In order to get effective cleaning at relatively high photoreceptor peripheral speeds it has been found necessary in accordance with this invention to provide a substantial increase in the gas velocity at the photoreceptor surface. One approach which could be utilized to provide such an increase would be to substantially increase the pressure and flow from the pressure ports. However, the pressures and flows, which would be required to provide adequate velocity for the gas at the surface of the photoreceptor could be high enough to make this system impractical for use from the standpoint of noise, power consumption, etc..

It has surprisingly been found, in accordance with this invention, that the velocity of the gas stream at the surface of the imaging member can be significantly increased at reasonable flows and pressures by reducing the gap between the cleaning shoe and the surface of the imaging member. Maintaining a thin gap is extremely difficult because of tolerance stack-ups in the apparatus which result in runout, for example, of the photoreceptor surface. Therefore, to provide a thin gap and at the same time maintain it substantially uniform as the imaging surface moves past the cleaning shoe, it is necessary to provide some means for supporting the cleaning shoe so that it will track the surface of the imaging member.

In accordance with this invention such a means comprises a gas bearing or gas cushion formed between the cleaning shoe and the surface of the imaging member so that the cleaning shoe floats against the surface while being spaced therefrom by a very narrow gap.

In accordance with this invention an apparatus and process are provided for cleaning the surface of an electrostatographic imaging member. The apparatus includes a means for impinging a gaseous medium under pressure against the surface to remove residual material from it. Means are included for applying suction to the surface for collecting the gaseous medium and the residual material and transporting them away from the surface. The apparatus includes means for supporting the impingement means and suction means close to the imaging surface without touching the surface. The supporting means includes means for forming a gas bearing between the imaging surface and the impingement means and suction means.

In accordance with one embodiment, the gas bearing is provided by a means for balancing the flow from the gas impingement means and the flow through the suction means.

In accordance with yet another embodiment, a means is provided for moving the gas impingement means and suction means close to the imaging surface when the impingement means is operating and away from the surface of the imaging member when the gas impingement means is not operating. Preferably, this movement is in response to the operation of the impingement means.

In accordance with other embodiments, means may be provided for simultaneously illuminating the imaging surface during cleaning and/or for simultaneously injecting ions into the gas stream. In accordance with yet other embodiments redundant cleaning means may be provided which may be selectively actuable.

Accordingly, it is an object of this invention to provide an improved apparatus and process for cleaning the surface of an electrostatographic imaging member.

It is a further object of this invention to provide an apparatus and process as above utilizing gas impingement and suction for cleaning the imaging surface.

It is still a further object of this invention to provide an apparatus and process as above wherein the cleaning device is spaced from the imaging surface by means of a gas bearing.

It is also an object of this invention to provide an electrostatographic reproducing machine employing the above cleaning apparatus.

These and other objects of the invention will become more apparent from the following description and drawings in which:

DETAILED DESCRIPTION

Figure 1:
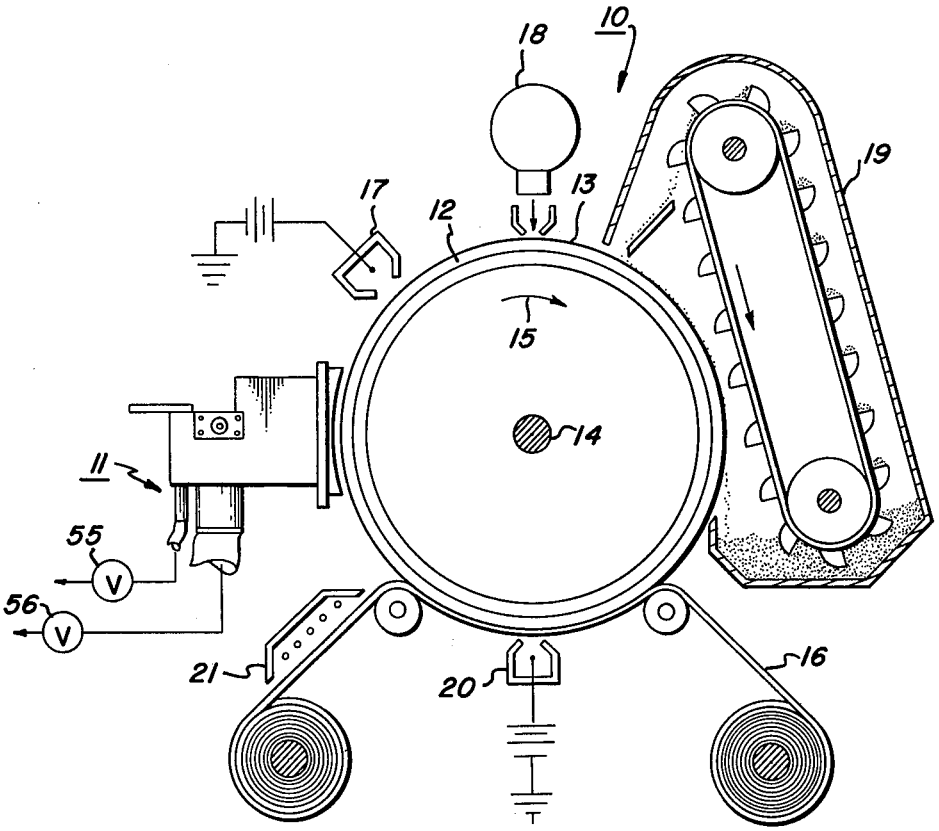
FIG. 1 is a schematic representation of a reproducing machine in accordance with the present invention.

Referring now to FIG. 1 there is shown by way of example an automatic xerographic reproducing machine 10 which incorporates the cleaning apparatus 11 of the present invention. The reproducing machine 10 depicted in FIG. 1 illustrates the various components utilized therein for producing copies from an original document. Although the cleaning apparatus 11 of the present invention is particularly well adapted for use in an automatic xerographic reproducing machine 10, it should become evident from the following description that it is equally well suited for use in a wide variety of electrostatographic systems and it is not necessarily limited in its application to the particular embodiment or embodiments shown herein.

Figure 2:
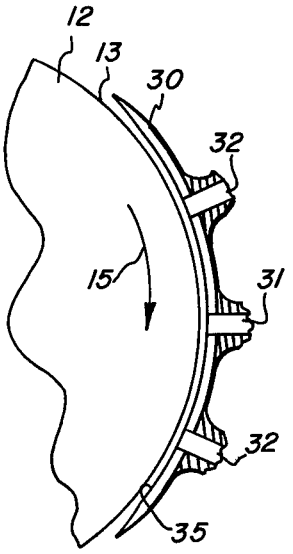
FIG. 2 is a partial cross-sectional view of a high velocity gas impingement and suction cleaning apparatus in accordance with the present invention.

The reproducing machine 10 illustrated in FIG. 2 employs an image recording drum-like member 12, the outer periphery of which is coated with a suitable photoconductive material 13. Alternatively, plate or web or belt-type recording members could be employed. One type of suitable photoconductive material is disclosed in U.S. Pat. No. 2,970,906, issued to Bixby. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproducing of the original input scene information is recorded upon a web or sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al.. After exposure, drum 12 rotates the electrostatic latent image recorded on the photoconductive surface 13 to development station 19 wherein a conventional developer mix including toner particles is cascaded over the photoconductive surface 13 rendering the latent image visible as a toner defined image.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16, the web with the image thereon is advanced to a suitable fuser 21 which coalesces the transferred powder image thereto. One type of suitable fuser is described in U.S. Pat. No. 2,701,765, issued to Codichini et al. After the fusing process the web 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are mechanically cleaned from the photoconductive surface 13 by the use of a gas impingement and suction cleaning apparatus as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The cleaning station 11 is positioned downstream from the transfer station 20 and upstream of the charging station 17. If desired, the removed toner can be returned for reuse to the developer station 19 by a suitable conveyor system.

Figure 3:
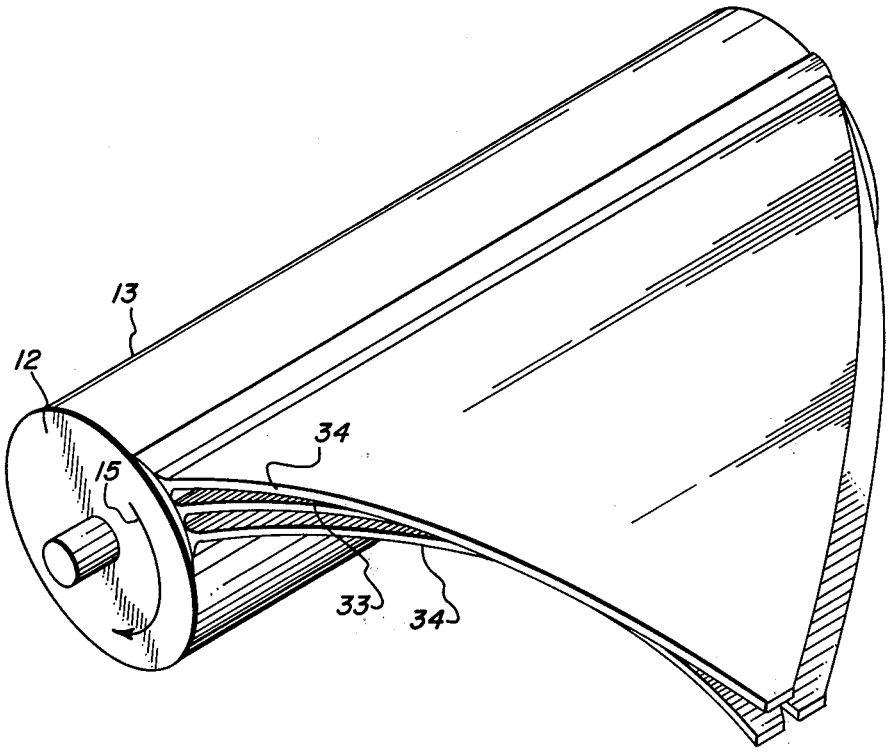
FIG. 3 is a perspective view of a cleaning apparatus in accordance with the present invention.

Referring now to FIGS. 2 and 3, a gas impingement and suction cleaning apparatus 11 in accordance with the present invention will be described. The apparatus includes a cleaning shoe 30 having a single pressure port 31 and two suction ports 32. The pressure port 31 communicates with a pressure manifold 33 which may be connected to any desired source of gas under pressure. The suction ports 32 communicate with vacuum manifolds 34 which in turn are connected to any desired vacuum source. The shoe 30 is positioned close to the surface 13 of the electrostatographic imaging member 12. A gas bearing or gas cushion is created between the surface 35 of the shoe facing the drum and surface 13 of the drum by properly balancing the gas flow rate through the pressure port 31 and the vacuum flow rate through the suction ports 32.

Referring to FIG. 4, in order to properly seal the cleaning apparatus 11 to prevent residual material removed by the cleaning apparatus from entering the machine environment the flow at the suction ports 32 is maintained high enough so that it collects the high velocity gas from the pressure port 31 and also draws in ambient air from the machine environment as shown by the arrows 36.

The cleaning shoe 30 is provided with a gas bearing surface 35 which faces the imaging surface 13 and follows its contour. So for a cylindrical drum 12 the gas bearing surface 35 would be concentric with the surface of the drum. Whereas for a flat plate or belt 12' the gas bearing surface 35 would be parallel to the surface of the imaging member. It is desirable to provide a uniform gap 38 between the imaging surface 13 and the bearing surface 35 over the area of the bearing surface.

In order to provide a stable gas bearing the cross-sectional area of the pressure port 31 preferably should be greater than the exit area of the gas. The exit area of the gas comprises the perimeter of the pressure port 31 multiplied by the thickness of the gap 38 between the bearing surface 35 and the surface 13 of the imaging member. Preferably, in accordance with this invention, the cross-sectional area of the pressure port 31 should be greater than about twice the product of the perimeter of the pressure port and the thickness of the gap 38.

It has been found desirable, in accordance with this invention, to provide undercut portions 40 in the bearing surface 35 of the cleaning shoe 30 about its outer perimeter and closely adjacent to the suction ports 32. The purpose of these undercut portions 40 is to reduce the negative pressure area over the entire shoe face to provide adequate control of the gas bearing. This aids in properly balancing the flow from the suction ports and the pressure port. If the negative pressure is too large on the shoe face, the air bearing will collapse and the cleaning shoe 30 will be sucked against the drum surface. Therefore, it is preferred in accordance with this invention to provide undercut portions 40 at the leading, trailing, and side edges of the cleaning shoe in order to reduce the total negative pressure area on the shoe face.

Creation of the gas bearing or air bearing when air comprises the gas medium allows the cleaning shoe 30 to track the moving imaging surface 13 thereby maintaining a uniform gap 38 between the cleaning shoe and that surface, and automatically accounts for any tolerance stack-ups and runout of the imaging surface.

The cleaning shoe is secured to a pressure manifold 33 which is provided in communication with the pressure port 31 and to vacuum manifold 34 which is provided in communication with the suction ports 32. Each of the manifolds is attached to a suitable source of gas under pressure or of vacuum, respectively (not shown).

Figure 4B:
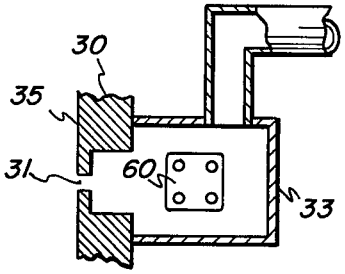
FIGS. 4*b* and 4*c* are further embodiments of a portion of the apparatus shown in full in FIG. 4*a*.
Figure 4C:
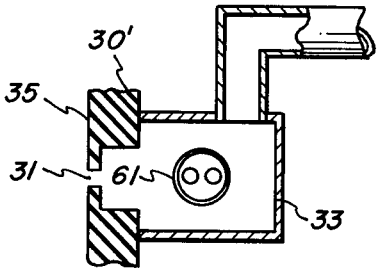
Figure 4A:
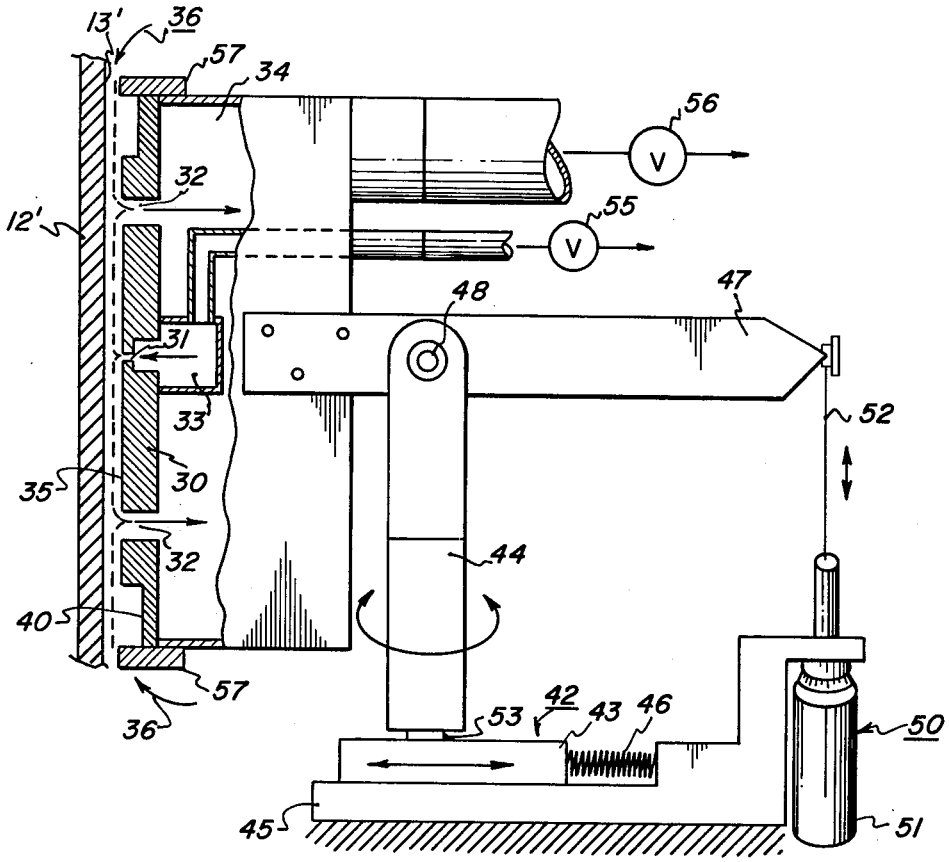
FIG. 4*a* is a side view in partial cross-section of an apparatus of this invention.

In order to support the cleaning shoe 30 so that it can properly track the imaging surface 13, the shoe is supported as shown in FIG. 4*a* for movement toward and away from the imaging surface and for tilting movement in both horizontal and vertical planes. The cleaning shoe shown in FIG. 4*a* is spaced from a flat photoconductive surface 13' as might be provided by either a flat plate 12' or a typical belt type photoreceptor.

Movement of the cleaning shoe 30 toward and away from the surface 13' of the imaging member 12' is provided by a low friction slide arrangement 42 which comprises a block 43 and a U shaped support member 44 pivotably mounted to the slide block. The slide block 43 may be made of any desired material having low friction properties such as, for example, Teflon. The slide block 43 slides on a portion of the machine frame 45 and may be keyed thereto. A spring 46 is provided between the machine frame 45 and the slide block 43 for withdrawing the head away from the imaging surface 13' when it is not operating.

Side members 47 are secured to each side of the vacuum manifold 34, and are pivotably supported at 48 in each of the arms of the U shaped support member 44. An adjustment means 50 for adjusting the vertical tilt of the shoe 30 is provided by means of a micrometer screw 51 which is connected by means of a cable 52 to the side members 47.

Pivoting the shoe about pivot 48 provides proper vertical alignment. Pivoting the shoe 30 about the pivot 53 of support 44 provides proper horizontal alignment and tracking of any horizontal skew in the imaging surface 13'. Movement of the shoe 30 toward and away from the surface by means of the slide arrangement 42 provides a proper tracking by the shoe of any runout of the imaging surface. In operation the pressure and vacuum are turned on, and balanced by means of valves 55 and 56, respectively, to create the air bearing between the cleaning shoe 30 and the photoreceptor surface 13'. It is apparent that if the cleaning system as initially turned on had too much suction, or if the suction were turned on first, then the cleaning shoe 30 would be sucked up against the imaging surface 13' causing severe damage to it. Therefore, some means is preferably provided for preventing the cleaning shoe 30 from contacting the imaging surface 30. Such a means is shown in FIG. 4*a* and comprises follower member 57 positioned at the leading and trailing edges of the cleaning shoe 30 and at each side. If the shoe were forced against the imaging surface 13' the followers 57 would ride against the imaging surface outside the normal imaging region, and maintain a gap between the bearing surface 35 and the imaging surface 13' of, for example, about 2 mills. The actual gap between the bearing surface 35 and the imaging surface 13' may be set as desired by properly balancing the suction and pressure flow rates by means of valves 55 and 56. A gap of from about 0.003 to about 0.015 inches has been found to be satisfactory for cleaning residual material from large solid areas with a preferred range of from about 0.003 to about 0.010 inches.

Referring now to FIGS. 4*b* and *c*, alternative embodiments in accordance with the present invention are shown.

Referring to FIG. 4*b*, corona emission wires 60 can be provided within the pressure port manifold 33 for providing ions in the gas stream to help neutralize the charge on the photoreceptor and any residual material thereon such as toner, much in the manner of the aforenoted Hudson patent. In accordance with the embodiment shown in FIG. 4*c*, simultaneous illumination of the photoreceptor surface can be obtained by providing a transparent shoe 30', and a suitable source of illumination 61 within the pressure manifold 33 such as the fluorescent tube, shown, in the manner of the aforenoted Hudson patent. Alternative arrangements as are known in the prior art or as otherwise desired for providing simultaneous illumination and/or ion bombardment can be provided in accordance with this invention.

Figure 5:
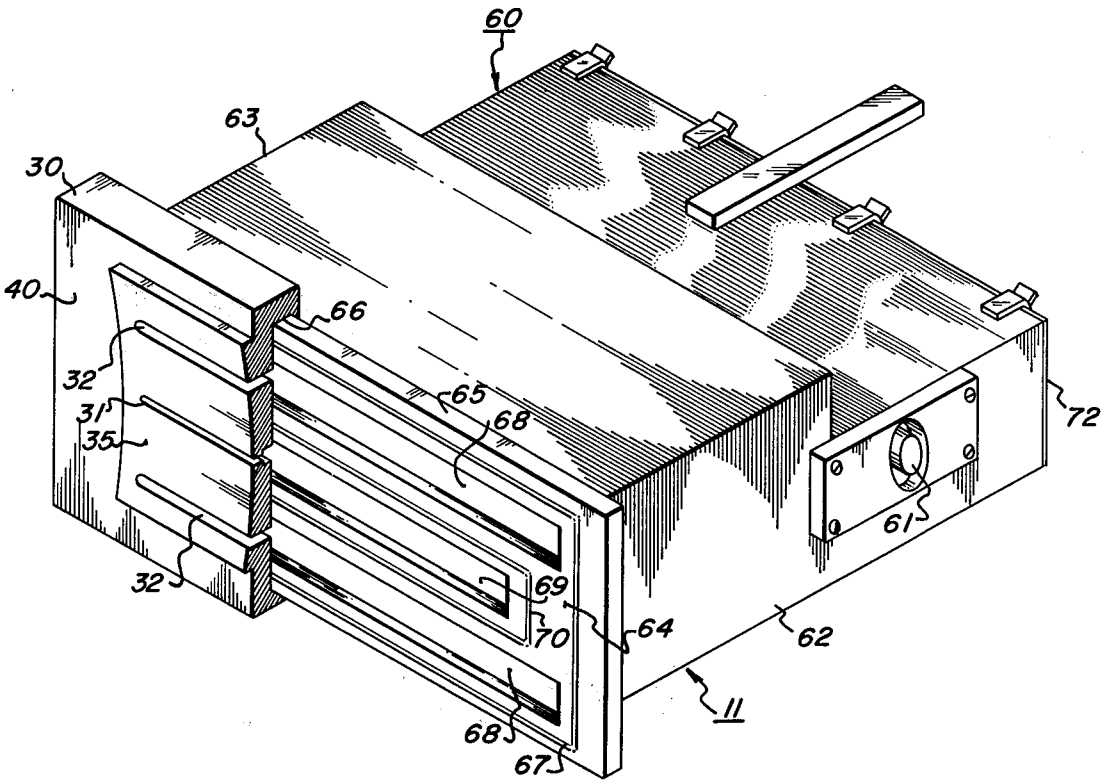
FIG. 5 is a perspective view in partial cross section of an alternative embodiment of this invention.
Figure 6:
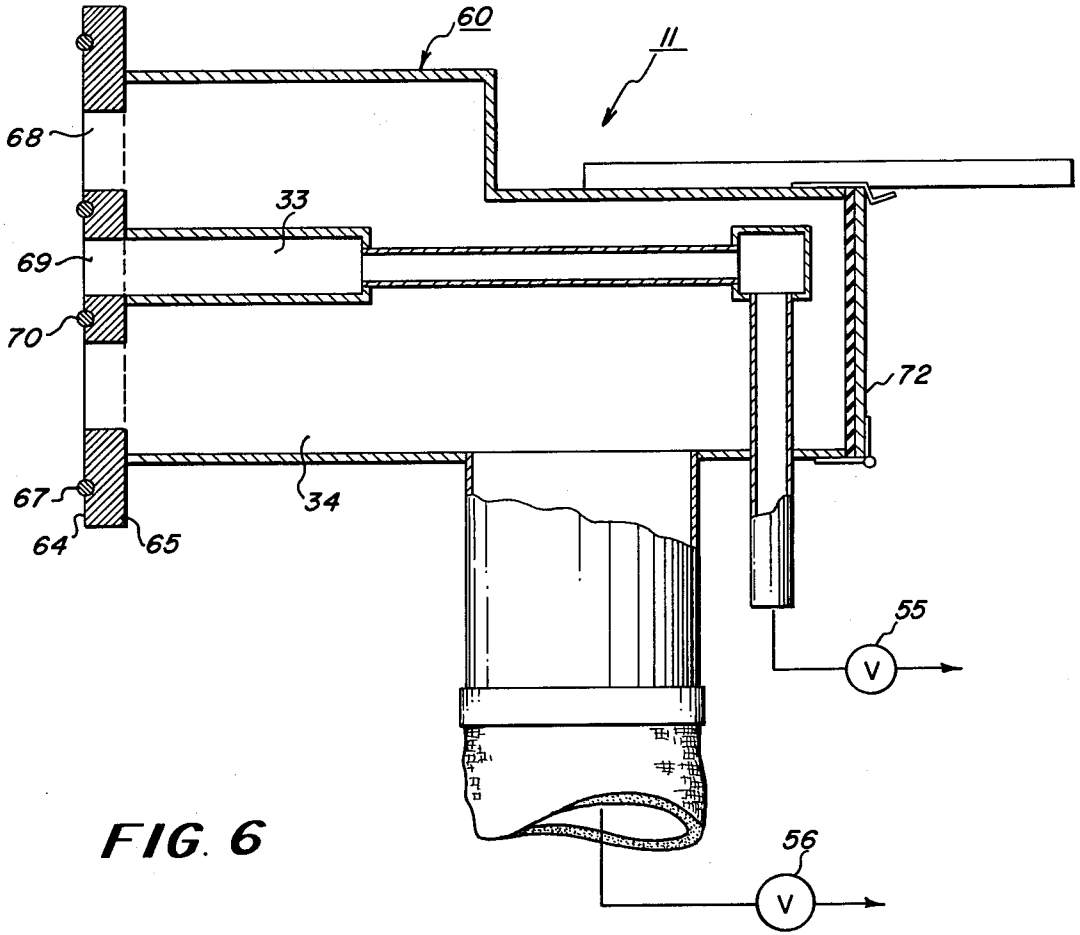
FIG. 6 is a side view in partial cross-section of the apparatus of FIG. 5.

Referring now to FIGS. 5 and 6, a preferred apparatus 11, in accordance with the present invention, is illustrated. The apparatus illustrated in FIGS. 5 and 6 comprises a housing 60 which can be supported for movement toward and away from the imaging surface 12 and for tilting movement in both the horizontal and vertical directions in the manner of the apparatus of FIG. 4*a*. The U shaped member 44 would be pivotably attached to the stub shafts 61 on each side 62 and 63 of the housing in the same manner as shown in FIG. 4*a*. The housing serves to define the vacuum manifold 34 for the suction ports 32. The housing 60 includes a front plate for supporting a removable cleaning shoe 30 having the pressure port 31 and suction ports 32. The front plate 64 includes a peripheral flange portion 65 adapted to mate with slot 66 in the shoe 30 so that the shoe 30 slides onto the front plate. Within the vacuum manifold 34 a pressure manifold 33 is supported which communicates with the front plate 64 of the housing. An O-ring gasket 67 surrounds the vacuum manifold slots 68 and the pressure manifold slot 69. A further O-ring gasket 70 surrounds the pressure manifold slot 69. The O-ring 67 and 70 serve as a seal between the pressure manifold 33, vacuum manifold 34, and the respective pressure and suction ports 31 and 32. The rear wall 72 of the housing is hinged so that it may be opened like a door to provide access to the inside of the vacuum manifold 34 and to the pressure manifold 33.

The cleaning shoe 30 which is removably supported by the housing 60 includes a first relatively narrow slot 31 which comprises the pressurized gas port, and two relatively wider slots 32 which comprise the suction ports. The front face of the shoe includes the gas bearing surface 35. In the embodiment of FIGS. 5 and 6 this surface has an arcuate shape so that the cleaning apparatus 11 can be placed with the bearing surface concentric with the surface of the photoreceptor drum as shown in FIG. 1. As with the shoe 30 of FIG. 4*a* previously described, the gas bearing surface 35 comprises only a portion of the front surface of the shoe, the remaining portion 40 is undercut so as to reduce the total negative pressure on the shoe face.

The slots 31 and 32 which comprise the vacuum or pressure ports have a length which extends across the axial width of the drum so the gas stream will engage any image bearing area of the surface 13. The spacing between the suction ports 32 and the pressure port 31 may be set as desired.

While slot-like ports are shown, each slot could, if desired, comprise a plurality of individual ports or jets. The air bearing or air cushion is created just as in the example stated with respect to FIG. 4, namely, by properly balancing the flow through the pressure port 31 and the suction ports 32 by means of valves 55 and 56.

Figure 7:
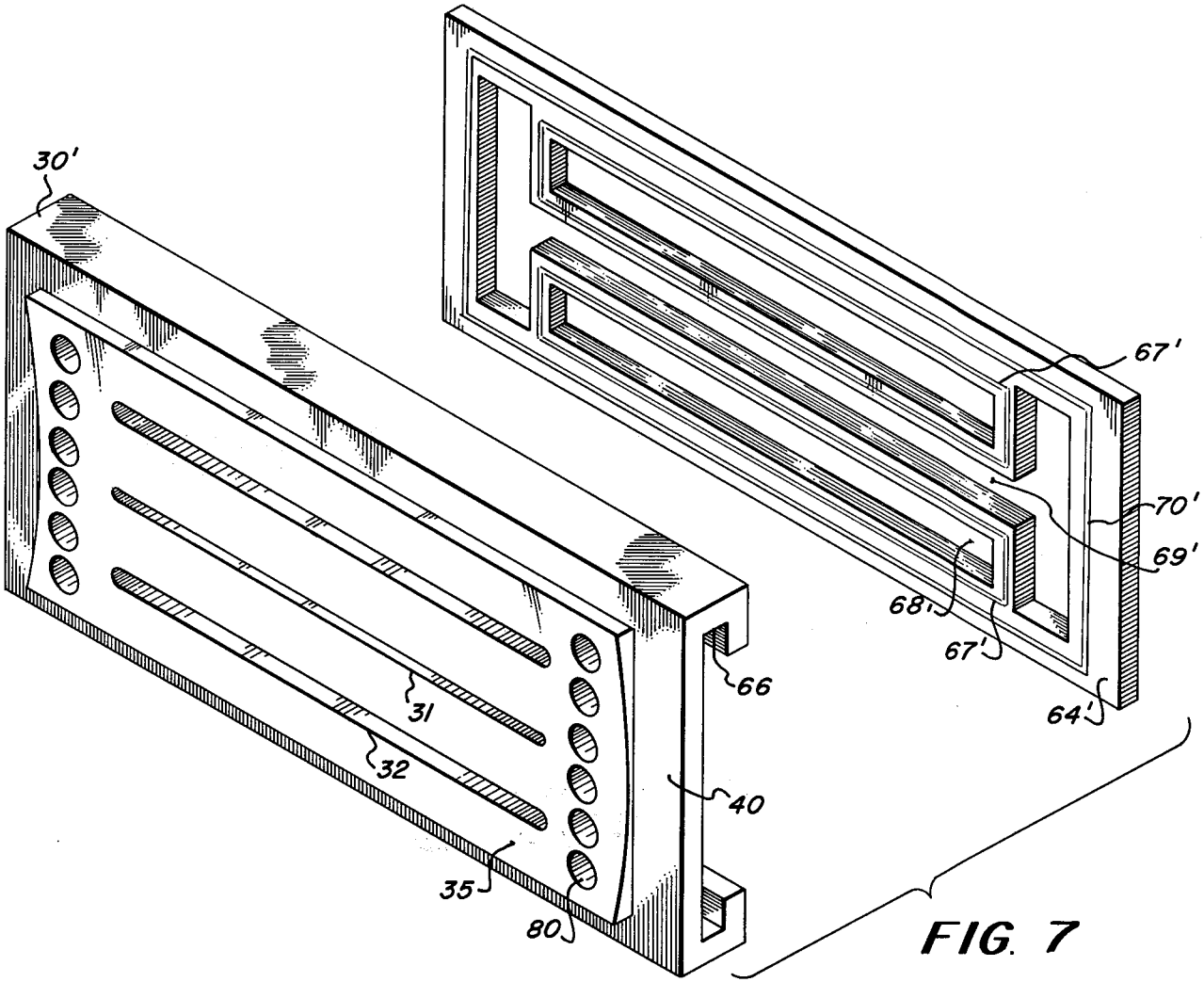
FIG. 7 is a partial perspective view in exploded form of an alternative embodiment of a cleaning apparatus of this invention.

Up until this point the air bearing has been described in terms of an air cushion created by balancing the flow through the suction ports 32 and the pressure port 31 and from the ambient. Alternatively, however, a plurality of orifices 80 as shown in FIG. 7 or other suitable means can be provided at the sides of the bearing surface 35 of the shoe 30'. The gas jets from the orifices impinges outside the imaging region of the imaging surface. The orifices are connected to a suitable source of gas under pressure or to the pressure manifold 33. By properly selecting the number and size of these orifices in a manner known in the art, an air bearing can be created at the sides of the cleaning shoe 30 to support the shoe close to, but spaced from, the surface of the imaging member. As in the previous embodiment, O-rings 67' and 70' are used to seal the manifold front plate 64' having slots 68' and 69' therein to the shoe 30'.

By providing separate ports for creating the air bearing a wider latitude is provided for adjusting the relative flows through the suction 32 and pressure 31 ports. Therefore, in accordance with this embodiment of the invention separate means are provided for creating the air cushion for supporting the shoe of the cleaning housing adjacent the imaging surface. However, as previously stated, the use of separate gas bearing ports 80 is not essential in accordance with this invention sicne the same gas bearing effect can be obtained by properly balancing the flows through the vacuum and pressure ports.

Figure 8:
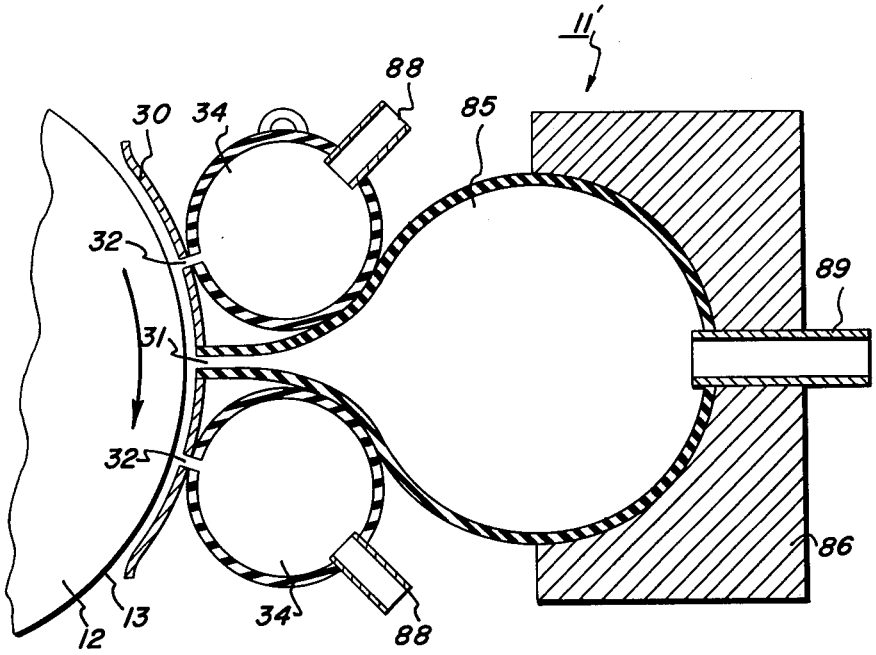
FIG. 8 is a side view in partial cross-section of an alternative embodiment of a cleaning apparatus of this invention.
Figure 9:
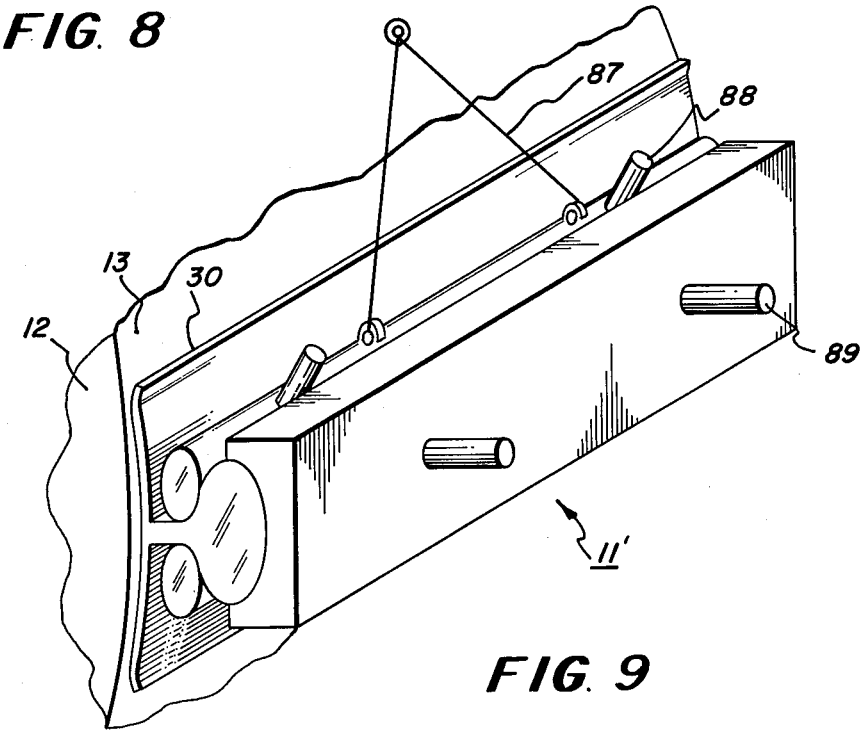
FIG. 9 is a perspective view of the cleaning apparatus of FIG. 8.

In FIG. 4*a*, a spring 46 is disclosed for purposes of withdrawing the cleaning apparatus 11 away from the imaging surface 13 when it is not operating. An alternative embodiment in accordance with the present invention for withdrawing the apparatus 11' when it is not in operation and moving the apparatus close to the imaging surface when it is in operation is shown in FIGS. 8 and 9. The apparatus includes a pressure manifold 85 and separate vacuum manifolds 34 which may be connected to a common source of vacuum. The cleaning shoe 30 is in every respect similar to those previously described, and includes a central pressure port 31 and two suction ports 32 disposed upstream and downstream of the pressure port.

The significant feature of the apparatus of FIGS. 8 and 9 is that the pressure manifold 85 is formed of a suitable stretchable material which renders the manifold inflatable. Upon the application of pressure, the manifold 85 inflates as shown in the Figures. This has the effect of pushing the cleaning shoe 30 toward the surface 13 of the drum 12. If desired, the degree of inflation of the manifold can be used to regulate the thickness of the gap between the cleaning shoe and the drum surface. Alternatively, outrigger shoes or rollers would be provided at the ends of the cleaning shoe and the drum surface. Further, in accordance with the previously discussed embodiments, the gap between the cleaning shoe and the drum surface can be maintained by means of a gas bearing or gas chshion created by the flows through the respective vacuum and pressure ports or by separate gas bearing ports as may be desired.

The apparatus in FIG. 8 may be suspended by any desired means as, for example, the cable suspension 87 shown in FIG. 9. The tubes 88 and 89 connected to each of the vacuum 34 and pressure 85 manifolds are connected to any desired sources of vacuum and gas under pressure (not shown).

The unique advantage of the apparatus shown in FIGS. 8 and 9 having an inflatable or pressure expandable manifold 85 is that it provides a means which is responsive to the operation of the cleaning apparatus 11' for moving the apparatus close to the drum surface to provide cleaning and for moving it away from the drum surface when operation ceases. In operation the inflation of the expandable manifold in FIG. 8 is constrained by the support block 86 having a conforming cavity therein. When the gas under pressure is cut off the manifold shrinks in diameter thereby pulling the entire cleaning apparatus 11 away from the drum surface. While the entire manifold has been described as being expandable, if desired, only a portion of it need be formed of expandable material.

Figure 10:
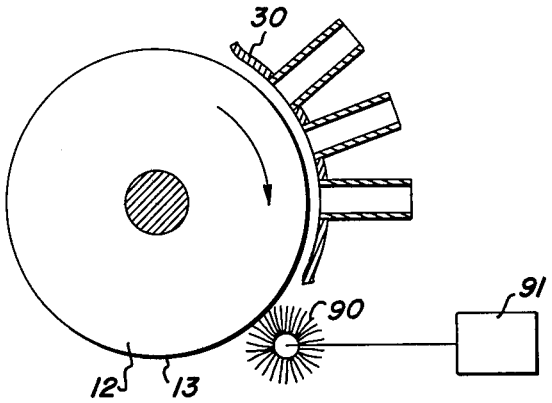
FIG. 10 is a side view of an alternative embodiment of a cleaning apparatus of this invention.

In accordance with this invention just as in U.S. Pat. No. 3,741,157, redundant cleaning devices can be provided following the gas impingement and suction cleaning apparatus 11 of the present invention. Referring to FIG. 10, a redundant cleaning apparatus 90 which comprises a conventional toner brush cleaner is shown downstream the gas impingement and suction cleaning shoe 30 in the direction of rotation of the drum. Also, as taught in U.S. Pat. No. 3,741,157 the redundant cleaning device 90 can be selectively actuable by means of a solenoid 91 or other suitable device. By selectively actuable it is meant that the redundant cleaning device 90 can be placed in or out of the operative engagement with the drum surface as desired.

Figure 11:
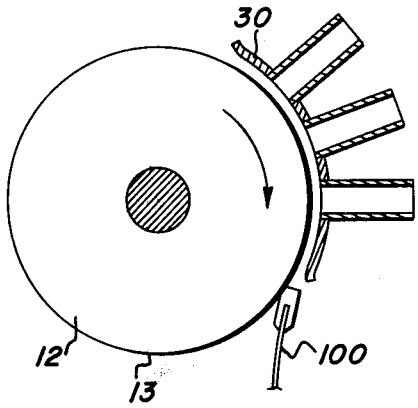
FIG. 11 is a side view of an alternative embodiment in accordance with the present invention.
Figure 12:
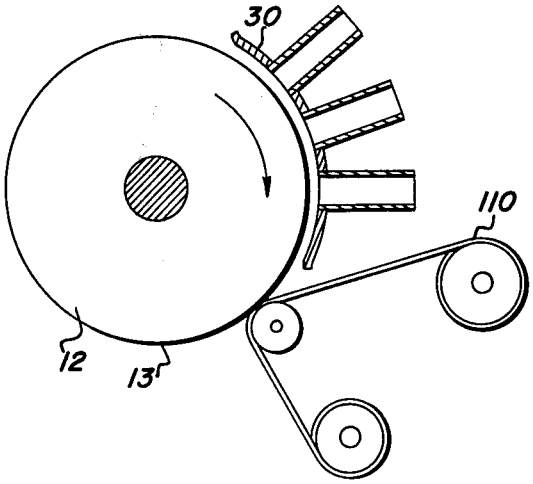
FIG. 12 is a side view of an alternative embodiment in accordance with this invention.

Referring to FIG. 11, an alternative redundant cleaning device is shown, namely, a resilient blade type cleaning element 100 as are well known in the art. In FIG. 12, a web-type toner cleaning device 110 used as a redundant cleaner is shown. If desired, both the blade 100 and web-type 110 devices could be selectively actuable just as in the case of the brush device 90 of FIG. 10. A typical web cleaning apparatus is disclosed for purposes of this invention in U.S. Pat. No. 3,099,856 to Eichorn et al. A typical blade cleaning device in accordance with this invention is shown, for example, in U.S. Pat. No. 3,742,351 to Oriel.

In tests of a gas impingement and suction apparatus 11 in accordance with this invention wherein the cleaning apparatus was used for removing solid areas of toner applied to the charged surface of a glass plate, it was found that as the gap between the cleaning shoe 30 and the surface of the plate was reduced, there was a substantial reduction in the flow required through the pressure port 31 and the vacuum ports 32 in order to obtain good cleaning results. For example, for a 5 mill gap excellent cleaning was obtained with a flow of 3 cubic feet per minute through the pressure port 31, and a 4 cubic feet per minute from the ambient atmosphere for a total vacuum flow of 7 cubic feet per minute. For a 13 mill gap comparable results were obtained at 4 cubic feet per minute from the atmosphere, for a total vacuum flow of 9.5 cubic feet per minute. Therefore, it is apparent that in accordance with this invention, excellent cleaning has been found to occur with reduced flow rates through the pressure port and suction ports by placing the cleaning shoe closer to the imaging surface.

The gas under pressure can be any desired gaseous medium, however, air is preferred since it can be readily filtered to remove the toner and release to the atmosphere.

In practice a slot width of about 1/64 to about 1/32 of an inch for the pressure ports 31 and a slot width of about 3/16 of an inch for the suction ports 32 have been employed, however they may be set as desired. Also, in practice the suction port slots have had a length 11/16 of an inch greater than the pressure port slot although slot lengths may be set as desired. A spacing of three-fourths of an inch between the pressure port and each of the suction ports has been employed, but any desired spacing could be employed. The flow rates through the respective ports may be set as desired to provide adequate cleaning and air bearing stability.

The patents and texts referred to specifically in this application are intended to be incorporated by reference into the application.

It is apparent that there has been provided in accordance with this invention a gas impingement and suction cleaning apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A process for cleaning the surface of an electrostatographic imaging member comprising:

providing a means for impinging a gas flow under pressure against said surface for removing residual material therefrom;

providing a means for applying suction to said surface to provide a suction flow for collecting said gas, said residual material and ambient air and transporting them away from said surface; and forming a gas cushion between said surface and said impingement means and said suction means for supporting said impingement means and said suction means close to said imaging surface.

2. An apparatus for cleaning the surface of an electrostatographic imaging member comprising:

means for impinging a gas flow under pressure against said surface for removing residual material therefrom;

means for applying suction to said surface to create on said surface an axes of negative pressure to provide a suction flow for collecting said gas, said residual material, and ambient air and transporting them away from said surface; and air bearing means for supporting said impingement means and said suction means close to said imaging surface, said air bearing means including means for forming a supporting gas cushion between said surface and said impingement means and suction means.

3. An apparatus for cleaning the surface of an electrostatographic imaging member comprising:

means for impinging a gas flow under pressure against said surface of removing residual material therefrom;

means for applying suction to said surface to provide a suction flow for collecting said gas, said residual material and ambient air and transporting them away from said surface; and air bearing means for supporting said impingement means and said suction means close to said imaging surface, said air bearing means including means comprising said impingement means and said suction means for forming a supporting gas cushion between said surface and said impingement means and said suction means said gas cushion forming means further including means for balancing the gas flow and the suction flow to create a stable gas cushion;

whereby the spacing between said impingement means and said suction means and said surface of said imaging member is a function of the balance between the gas and suction flows.

4. An apparatus as in claim 3, wherein said impinging means and said suction means comprise a cleaning shoe positioned adjacent said surface said cleaning shoe including at least one pressure port and suction ports positioned about said pressure port, said shoe further including a bearing face in opposition to said imaging surface to define a gap, said gas cushion being formed between said bearing face and said surface in said gap.

5. An apparatus as in claim 4, wherein said gap is from about 0.003 to about 0.015 inches.

6. An apparatus as in claim 4, wherein said bearing face is planar and parallel to said imaging surface.

7. An apparatus as in claim 4, wherein said bearing face is arcuate and is concentric with said imaging surface.

8. An apparatus as in claim 4, wherein means are provided for reducing the area of negative pressure on the bearing face.

9. An apparatus as in claim 8, wherein said area of negative pressure reducing means comprises an undercut portion in said bearing face adjacent said suction ports.

10. An apparatus as in claim 4, wherein said shoe is formed of a transparent material and wherein said apparatus further includes means positioned behind said shoe for providing illumination of said imaging surface.

11. An apparatus as in claim 4, further including means for injecting ions into said impinging gas flow.

12. An apparatus as in claim 4, further including follower means connected to said shoe, said follower means being arranged to ride in contact with said imaging surface for maintaining a minimum spacing between said imaging surface and said bearing face.

13. An appartaus as in claim 4, wherein said support means includes means for supporting said shoe for movement toward and away from said imaging surface, means for supporting said shoe for tilting movement in a vertical plane and means for supporting said shoe for tilting movement in a horizontal plane, said apparatus further including a vacuum manifold communicating with said suction ports and a pressure manifold communicating with said pressure port.

14. An apparatus as in claim 13, wherein said pressure port comprises a narrow elongated slot extending across said imaging surface and wherein said suction ports comprise relatively wider elongated slots extending across said imaging surface.

15. An apparatus as in claim 4, wherein the cross-sectional area of said pressure port is greater than about twice the product of the perimeter of said pressure port and the thickness of said gap.

16. An apparatus as in claim 3, further including means for withdrawing said impingement means and said suction means away from said imaging surface when said apparatus is not operating.

17. An apparatus as in claim 16, wherein said withdrawing means includes means for supporting said impingement means and suction means for movement toward and away from said surface, and means for biasing said movement means in a direction away from said surface, whereby when said suction means is inoperative said apparatus will be withdrawn from said surface.

18. An apparatus as in claim 16, wherein said withdrawing means is pressure responsive to said gas flow for providing said movement away from said surface, and wherein it comprises an expandable manifold connected to said impingement means.

19. An apparatus for cleaning the surface of an electrostatographic imaging member comprising:

means for impinging a gas flow under pressure against said surface for removing residual material therefrom;

means for applying suction to said surface to provide a suction flow for collecting said gas, said residual material and ambient air and transporting them away from said surface; and means responsive to the operation of said cleaning apparatus for positioning said impingement means and suction means close to said imaging surface during operation of said cleaning apparatus and for withdrawing said impingement means and suction means away from said imaging surface when said apparatus is not operating.

20. An apparatus as in claim 19, wherein said positioning means further includes means for supporting said impingement means and said suction means for movement toward and away from said surface and means for biasing said supporting means in a direction away from said surface, whereby when said suction means is inoperative said apparatus is withdrawn from said surface.

21. An apparatus as in claim 20, wherein said positioning means is pressure responsive to said gas flow for providing said movement toward and away from said surface.

22. An apparatus as in claim 21, wherein said responsive positioning means includes an expandable manifold connected to said impingement means.

23. An electrostatographic reproduction apparatus comprising a movable member having an imaging surface thereon; means for forming an electrostatic image on said surface, means for developing said image to render it visible; and means for transferring said developed image to a sheet of final support material; such apparatus further including means for cleaning said surface following transfer of said image to said sheet, said cleaning means comprising:

means for impinging a gas flow under pressure against said surface for removing residual material therefrom;

means for applying suction to said surface to provide a suction flow for collecting said gas, said residual material and ambient air and transporting them away from said surface; and air bearing means for supporting said impingement means and said suction means close to said imaging surface, said air bearing means including means for forming a supporting gas cushion between said surface and said impingement means and suction means.

24. An electrostatographic reproduction apparatus comprising a movable member having an imaging surface thereon; means for forming an electrostatic image on said surface; means for developing said image to render it visible; and means for transferring said developed image to a sheet of final support material; said apparatus further including means for cleaning said surface following transfer of said image to said sheet; said cleaning means comprising:

means for impinging a gas flow under pressure against said surface for removing residual material therefrom;

means for applying suction to said surface to provide a suction flow for collecting said gas, said residual material and ambient air and transporting them away from said surface;

and air bearing means for supporting said impingement means and said suction means close to said imaging surface, said air bearing means including means comprising said impingement means and said suction means, for forming a supporting gas cushion betwen said surface and said impingement means and suction means, said gas cushion forming means further including means for balancing the gas flow and the suction flow to create a stable gas cushion;

whereby the spacing between said impingement means and said suction means and said surface of said imaging member is a function of the balance between the gas and suction flows.

25. An apparatus as in claim 24, wherein said impinging means and said suction means comprise a cleaning shoe positioned adjacent said surface said cleaning shoe including at least one pressure port and suction ports positioned about said pressure port, said shoe further including a bearing face in opposition to said imaging surface to define a gap, said gas cushion being formed between said bearing face and said surface in said gap.

26. An apparatus as in claim 25, wherein said gap is from about 0.003 to about 0.015 inches.

27. An apparatus as in claim 25 wherein said bearing face is planar and parallel to said imaging surface.

28. An apparatus as in claim 25, wherein said bearing face is arcuate and is concentric with said imaging surface.

29. An apparatus as in claim 25, wherein means are provided for reducing the area of negative pressure on the bearing face.

30. An apparatus as in claim 29, wherein said area of negative pressure reducing means comprises an undercut portion in said bearing face adjacent said suction ports.

31. An apparatus as in claim 25, wherein said shoe is formed of a transparent material and wherein said apparatus further includes means positioned behind said shoe for providing illumination of said imaging surface.

32. An apparatus as in claim 25, further including means for injecting ions into said impinging gas flow.

33. An apparatus as in claim 25, further including follower means connected to said shoe, said follower means being arranged to ride in contact with said imaging surface for maintaining a minimum spacing between said imaging surface and said bearing face.

34. An apparatus as in claim 24, further including means for withdrawing said impingement means and suction means away from said imaging surface when said apparatus is not operating.

35. An apparatus as in claim 34, wherein said withdrawing means includes means for supporting said impingement means and suction means for movement toward and away from said surface, and means for biasing said movement means in a direction away from said surface, whereby when said suction means is inoperative said apparatus will be withdrawn from said surface.

36. An apparatus as in claim 35, wherein said withdrawing means is pressure responsive to said gas flow for providing said movement toward and away from said surface, and wherein it comprises an expandable manifold connected to said impingement means.

37. An apparatus as in claim 25, wherein said support means includes means for supporting said shoe for movement toward and away from said imaging surface, means for supporting said shoe for tilting movement in a vertical plane and means for supporting said shoe for tilting movement in a horizontal plane, said apparatus further including a vacuum manifold communicating with said suction ports and a pressure manifold communication with said pressure port.

38. An apparatus as in claim 37, wherein said pressure port comprises a narrow elongated slot extending across said imaging surface and wherein said suction ports comprise relatively wider elongated slots extending across said imaging surface.

39. An apparatus as in claim 25, wherein the cross-sectional area of said pressure port is greater than about twice the product of the perimeter of said pressure port and the thickness of said gap.

40. A process for cleaning the surface of an electrostatographic imaging member comprising:

providing a means for impinging a gas flow under pressure against said surface for removing residual material therefrom;

providing a means for applying suction to said surface to provide a suction flow for collecting said gas, said residual material and ambient air and transporting them away from said surface;

forming a gas cushion between said surface and said impingement means and suction means for supporting said impingement means and suction means close to said imaging surface, said gas cushion forming step including said steps of impinging a gas flow under pressure against said surface and applying suction to said surface; and further including the step of balancing said gas flow and suction flow to create a stable gas cushion.

41. A process as claim 40, further including the step of simultaneously illuminating said surface during said impinging and applying steps.

42. A process as in claim 40, further including the step of injecting ions into said gas flow.

43. A process as in claim 1, further including the step of injecting ions into said gas flow.

44. A process as in claim 40, further including the step of positioning said impingement means and said suction means away from said surface following said impinging and applying steps.

45. A process as in claim 44, wherein said positioning step takes place in response to the ending of said suction applying step.

46. A process as in claim 40, further including the steps of forming an electrostatic image on said surface; developing said image to render it visible; and transferring said developed image to a sheet of final support material prior to said gas impingement and suction applying steps.

47. A process for cleaning the surface of an electrostatographic imaging member comprising:

providing a means for impinging a gas flow under pressure against said surface for removing residual material therefrom;

providing a means for applying suction to said surface to provide a suction flow for collecting said gas, said residual material and ambient air and transporting them away from said surface;

impinging said gas against said surface;

applying said suction to said surface; and simultaneously with and in pressure response to said impinging and applying steps, positioning said impingement means and said suction means developing said to said surface; and moving said impingement means and said suction means away from said surface following said impinging and applying steps.

48. A process as in claim 47, further including the steps of forming an electrostatic image on said surface; developingsaid image to render it visible; and transferring said developed image to a sheet of final support material prior to said gas impingement and suction applying steps.

* * * * *